US010206450B1

(12) United States Patent
Krastev

(10) Patent No.: US 10,206,450 B1
(45) Date of Patent: Feb. 19, 2019

(54) QUICK RELEASE AND INTERCHANGEABLE SANDAL STRAP/FLIP FLOP STRAP CRAFTING SYSTEM

(71) Applicant: Pavel Krastev, New Hyde Park, NY (US)

(72) Inventor: Pavel Krastev, New Hyde Park, NY (US)

( * ) Notice: Subject to any disclaimer, the term of this patent is extended or adjusted under 35 U.S.C. 154(b) by 28 days.

(21) Appl. No.: 15/267,201

(22) Filed: Sep. 16, 2016

Related U.S. Application Data

(63) Continuation-in-part of application No. 15/267,190, filed on Sep. 16, 2016, now Pat. No. 10,104,931.

(60) Provisional application No. 62/251,204, filed on Nov. 5, 2015, provisional application No. 62/220,323, filed on Sep. 18, 2015.

(51) Int. Cl.

| | |
|---|---|
| ***A43B 3/10*** | (2006.01) |
| ***A43B 3/24*** | (2006.01) |
| ***A43B 3/12*** | (2006.01) |
| ***A43B 23/24*** | (2006.01) |
| ***A43B 3/00*** | (2006.01) |
| ***A43B 1/00*** | (2006.01) |

(52) U.S. Cl.
CPC ..... *A43B 3/24* (2013.01); *A43B 1/0036* (2013.01); *A43B 3/001* (2013.01); *A43B 3/0078* (2013.01); *A43B 3/10* (2013.01); *A43B 3/103* (2013.01); *A43B 3/105* (2013.01); *A43B 3/122* (2013.01); *A43B 3/126* (2013.01); *A43B 3/128* (2013.01); *A43B 23/24* (2013.01)

(58) Field of Classification Search
CPC ..... A43B 23/24; A43B 1/0036; A43B 3/10; A43B 3/103; A43B 3/105; A43B 3/126; A43B 3/122; A43B 3/128; A43B 3/0078
USPC ..... 36/11.5
See application file for complete search history.

(56) References Cited

U.S. PATENT DOCUMENTS

| | | | | |
|---|---|---|---|---|
| 2006/0213080 | A1* | 9/2006 | Sussman | A43B 3/0078 36/12 |
| 2008/0060227 | A1* | 3/2008 | Enderson | A43B 3/103 36/100 |
| 2010/0058619 | A1* | 3/2010 | Ferrante | A43B 3/126 36/136 |
| 2011/0239484 | A1* | 10/2011 | Giovannetti | A43B 3/103 36/11.5 |
| 2012/0186109 | A1* | 7/2012 | Vanderbeek | A43B 3/0078 36/136 |
| 2012/0240624 | A1* | 9/2012 | Van Dyne | A41D 27/08 63/33 |

(Continued)

*Primary Examiner* — Ted Kavanaugh
(74) *Attorney, Agent, or Firm* — Thomas A. O'Rourke; Bodner & O'Rourke, LLP

(57) ABSTRACT

A customizable flip flop includes a colored sole: a quick release fastener; a "thong" formed as a post having a bottom portion fixedly secured to the sole, and an upper portion formed with a receptacle to releasably secure the fastener thereto; and first and second straps. A first end of each strap is secured to a respective side at the rear of the sole. A second end of each strap comprises a ring that is received upon the shaft of the fastener, to releasably secure the straps' second ends to the post. Between each of its ends, the straps may be formed as a tube. Prior to securing the rings of each strap to the post, a plurality of colored plastic loops or rubber bands are received on each strap/tube, to customize coloring of the straps as desired, and to provide added comfort to the top of the wearer's foot.

12 Claims, 11 Drawing Sheets

(56) References Cited

U.S. PATENT DOCUMENTS

| | | | | |
|---|---|---|---|---|
| 2013/0091732 | A1* | 4/2013 | Mendoza | A43B 3/0078 36/100 |
| 2014/0259772 | A1* | 9/2014 | Hazarian | A43B 3/105 36/94 |
| 2017/0258174 | A1* | 9/2017 | Williams | A43B 3/24 |

* cited by examiner (Customized Sandal)

(Sandal Craft Kit)

FIG. 2C
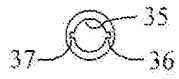
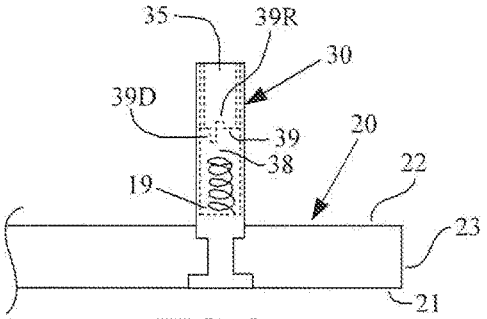
FIG. 2A
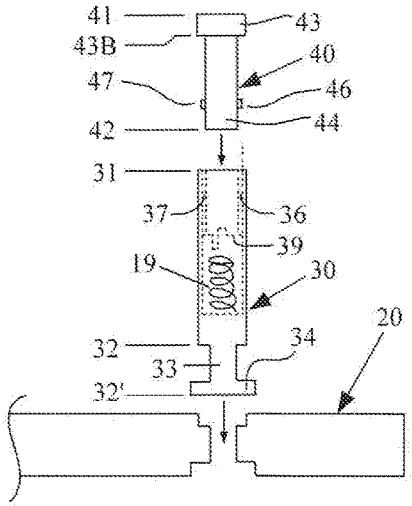
FIG. 2B
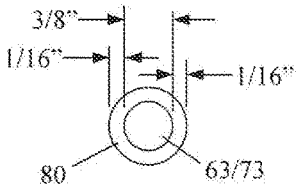
FIG. 2F
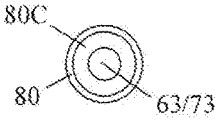
FIG. 2G
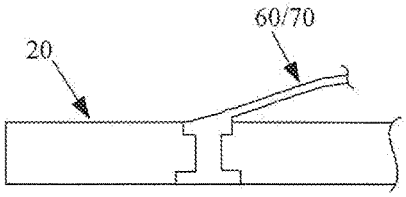
FIG. 2D
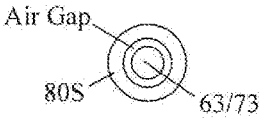
FIG. 2H
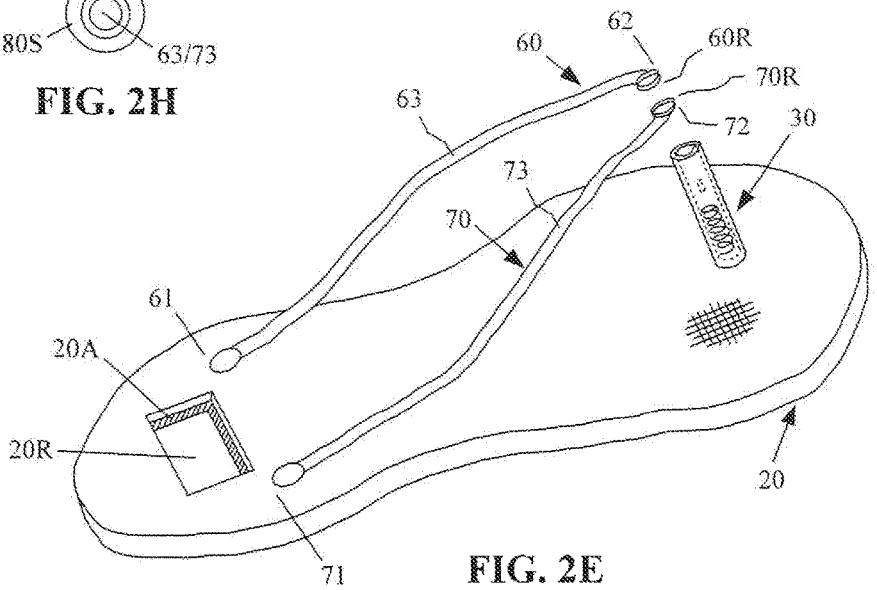
FIG. 2E

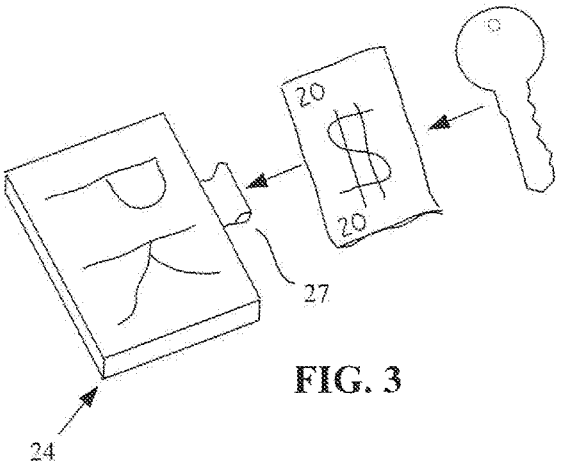
FIG. 3
FIG. 3C
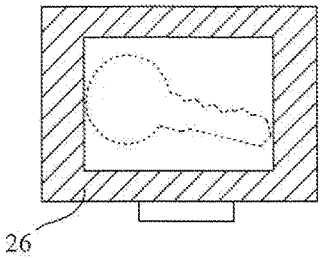
FIG. 3B
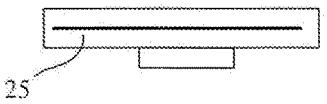
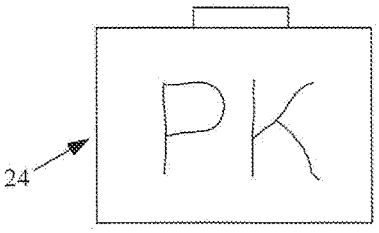
FIG. 3A

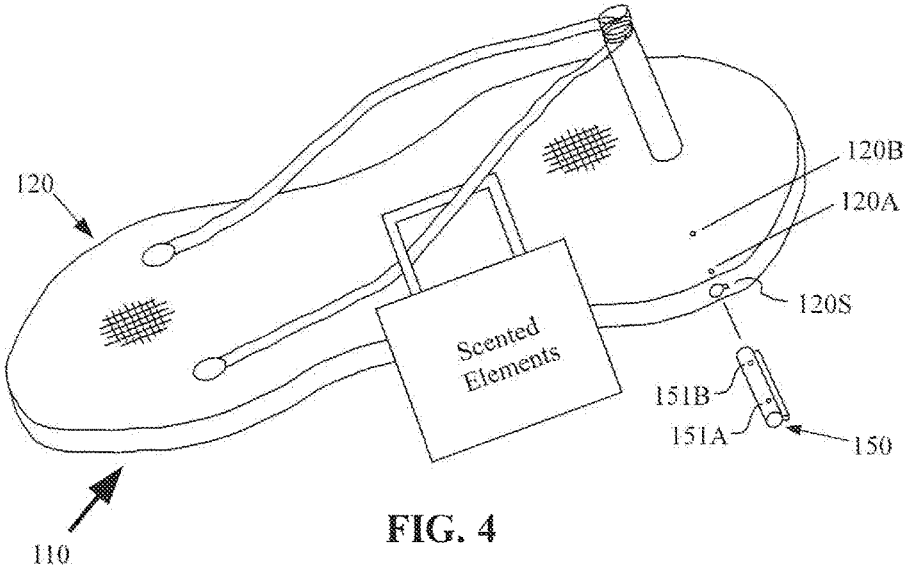
FIG. 4
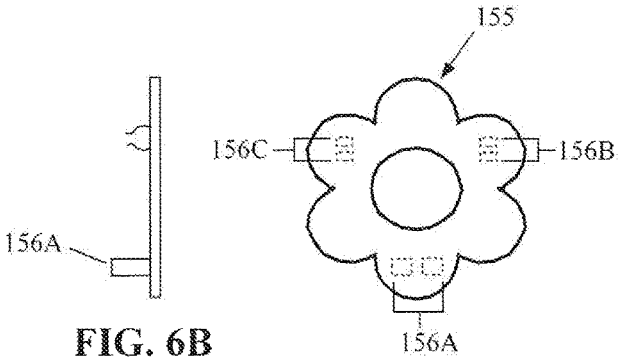
FIG. 6B
FIG. 6A
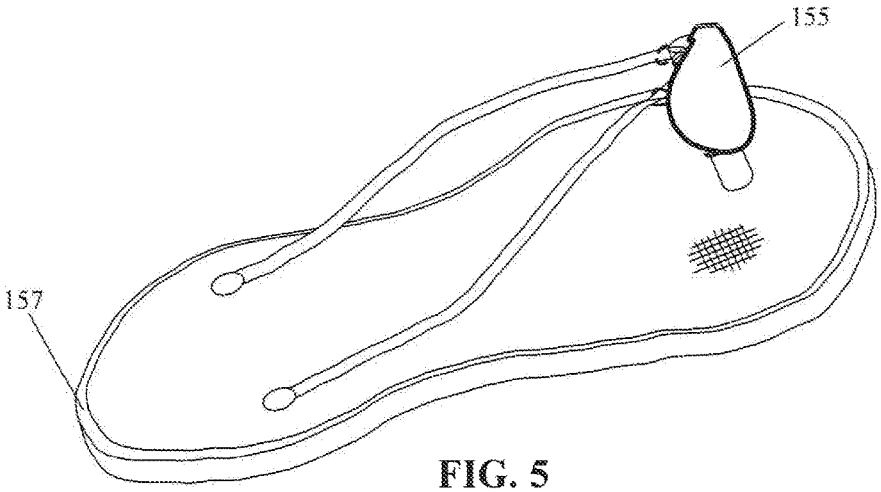
FIG. 5

(Prior Art Flip Flop)

QUICK RELEASE AND INTERCHANGEABLE SANDAL STRAP/FLIP FLOP STRAP CRAFTING SYSTEM

CROSS REFERENCES TO RELATED APPLICATIONS

This application is a continuation in part of U.S. application Ser. No. 15/267,190, filed Sep. 16 2016, and also claims priority on U.S. Provisional Application Ser. No. 62/220,323, filed on Sep. 18, 2015, and on U.S. Provisional Application Ser. No. 62/251,204, filed on Nov. 5, 2015, all disclosures of which are incorporated herein by reference.

FIELD OF THE INVENTION

The present invention relates to improvements in footwear, and more particularly to an improved sandal and a method of making the same.

BACKGROUND OF THE INVENTION

For many people, particularly for women, it is often more important for footwear being worn to be in accordance with personal taste, and to be coordinated with other garments worn and accessories being carried, than for it to be very comfortable. With sandals or "flip-flops," it is generally accepted by large numbers of people that such footwear can be quite uncomfortable, which is evidenced by the many blogs that are returned by an internet search of that issue (see e.g., the commentary on "Yahoo! Answers" for the subject "Do flip flops always hurt?").

The typical pair of flip flops consist of a generally flat sole, to which is connected a pair of straps or an integrated strap arrangement. One end of each of the straps is respectively connected to the sole, proximate to each side of the heel region. The other end of the straps may be interconnected, and which are furthermore coupled to the sole near its front, using a post, or what is more commonly referred to as a "thong." The straps are thus configured to loop over the top of the wearer's foot, while the thong is configured to be received between the wearer's big toe and second toe, with the sole being shaped to provide support for the entirety of the platform provided for the wearer's foot. These flip flops are not only worn at the beach to thereat be quickly removed to enjoy the sand and water, but are also often worn in a public shower, and at other casual outings, at restaurants, etc. Sandals are similarly constructed, but typically also include an additional strap that may be secured about the wearer's ankle. Those two terms—"sandals" and "flip flops" are used interchangeably herein, with that distinction in mind, as the craft system of the present invention may be utilized on the upper ankle strap of a sandal, as well as the straps that loop over the top of the wearer's foot for a simple flip flop.

In view of the expense of purchasing numerous pairs of different styled/colored flip flops, and the requisite storage requirements, there have been a number of prior art inventions that have sought to provide interchangeability with respect to an upper portion of a sandal, to economically leverage the use of a single pair of footwear. For example, U.S. Pat. No. 3,011,281 to King teaches providing different decorative facings which may attach onto the straps using snaps, so that it may be worn on different occasions and may thus appear differently. U.S. Pat. No. 6,769,204 to Phillips similarly teaches attachment of a decorative "ribbon" using Velcro.

However, most of the prior art sandal arrangements that provide some type of interchangeability to provide various different styles and appearance, do not address the comfort thereby provided to the wearer, particularly with respect to the bottom of the straps. Moreover, those arrangements typically only address one limited aspect of the appearance of the sandal.

The novel sandal crafting system and method of construction disclosed herein also achieves interchangeability with respect to the upper portion of a flip flop or sandal, but does so to a greater extent to provide increased customization, while simultaneously increasing the comfortability of the footwear to the wearer.

OBJECTS OF THE INVENTION

It is an object of the invention to provide a flip flop footwear arrangement, the assembly of which may provide an appearance that may be customized.

It is another object of the invention to provide a flip flop footwear arrangement that may be easily and quickly customized by a wearer at home.

It is also an object of the invention to provide a flip flop with interchangeable component parts that may permit customization without the use of tools such as wrenches, screw drivers, etc.

It is a further object of the invention to provide a flip flop footwear arrangement that permits individual customization of each of the straps.

It is another object of the invention to provide a flip flop design that permits customization of the thong of the footwear.

It is a further object of the invention to provide a flip flop design that permits customization of the straps while increasing comfort with respect to its contact with the top of a wearer's foot.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A customizable flip flop or sandal may include a sole of a first color: a quick release fastener; a "thong" formed as a post, and first and second straps. A bottom portion of the post may be fixedly secured to the sole at a position configured for the post to be received between a big toe and a second toe of the wearer of the sandal. An upper portion of the post may be formed with a receptacle that is configured to releasably secure the quick release fastener to the post.

A first end of each strap may be secured to a respective side of a rear portion of the sole (e.g., a side of the top of the sole, or a peripheral side of the sole). A second end of each strap may be formed to include a ring. Between each of its ends, the first and second straps may both be formed using the rectangular cross-section conventionally used for flip flops, or it may alternatively be formed as a flexible cylindrical member, or a hollow tube. Each of the first and second straps may thus receive a plurality of plastic loops or rubber bands over its ring, and onto the respective flexible member/tube. Each of the loops/bands may be individually selected by the person customizing the sandal, from a plurality of colors and thicknesses for such loops/bands, and may place each colored loop/band at a particular location on the tube to achieve a desired color pattern for the resulting strap. Once all of the desired loops/bands have been placed onto the straps by the person, the shaft of the quick release fastener may be inserted through each of the rings at the second ends of each of the first and second straps, and it may then be releasably coupled to the receptacle of the post.

This customization process may be repeatedly performed, as the wearer may remove the quick release fastener, and may replace the loops/bands with other colored loops/bands, which may also be formed of various other thicknesses.

To permit further customization, the post may be sized to receive a sleeve thereon, prior to securing of the rings of the straps by the quick release fastener. The sleeve may be selected from a plurality of different colored sleeves that may be supplied as part of a sandal crafting kit. The kit may also contain a plurality of the quick release fasteners, each of which may have its head finished with a different color or pattern. Thus the colored fastener and the colored sleeve for the post may be selected by the wearer to match the color of the sole, or alternatively they may be selected to provide contrast with the color of the sole, and/or to contrast each other.

In addition, rather than fixedly securing the first end of the straps to the sole of the sandal, each of those first ends may also be formed to include a ring, and may similarly be releasably secured to the rear portion of the sole using a quick release fastener. This may permit the wearer to also interchange the custom colored straps with colored bands placed thereon, with other various different colored soles.

The tubes of the straps may be formed of a clear flexible material, and may furthermore be filled with a combination of glitter and a liquid. Additionally/alternatively, the tubes may be a particular color, permitting the wearer to use the straps without the rubber bands placed thereon. Moreover, the tubes of the straps may additionally/alternatively be formed of a photoluminescent material (e.g., between fluorescence, or phosphorescence), which may absorb photons when present in the environment either from natural daylight or from artificial lighting, and may thereafter glow in the dark, and may thus light up the colored rubber bands from the inside. To better light up the colored rubber bands, an LED tube may be used for each of the straps. Additionally/alternatively, the rubber bands themselves may be formed of or coated with a photoluminescent material.

In addition to providing for customizing of the sandal, the use of an elastomeric material for the colored bands also serves to provide greater comfort to the top of the wearer's foot when the sandal is worn.

To further assist the wearer in customizing the straps of the sandal, the rubber bands may be supplied as a strip of bands that are all interconnected along a line at one exterior side of the bands. The rubber band strip may resemble a tube with a series of slits oriented normal to its axis, with the slits being provided throughout its length. A kit may contain many such rubber band strips, some of which may be the same color, and many of which may be a different color. Thus, the person may peel off individual rubber bands from a strip, or may instead separate off groups of such colored rubber bands for placement onto the strap(s). This may aid a person seeking to alternately place groups of rubber bands successively on the tube (i.e., 5 red colored bands, then 5 orange colored bands, followed by 5 yellow bands, etc.).

Moreover, the strip of rubber bands that may be supplied in the sandal craft kit may be of sufficient length such that it may completely cover the entire length of the tube/strap. So, if the wearer so chooses, each of the straps may be mono-colored by receiving a complete rubber band strip thereon, and each strap may having matching colored bands thereon, or each may receive a different colored strip of rubber bands, each of which may be easily and quickly interchanged. If the user desires to separate the bands once placed on the tube/strap, which may nonetheless present such an appearance, they may easily be separated by hand once placed onto the tubes of the straps. Alternatively, the connection between the bands on the strip may be very slight (i.e., the slit is almost entirely through the cylindrical rubber strip), so the bands may naturally separate over the course of a brief amount of time through contact with the user's foot while they being worn, as the user walks about normally.

BRIEF DESCRIPTION OF THE DRAWINGS

The description of the various example embodiments is explained in conjunction with appended drawings, in which:

FIG. 2A is side cross-sectional view of the sole and post of the sandal kit illustrated in FIG. 2, and being shown with the post fixedly secured to the sole;

FIG. 2B is an exploded side view showing the sole of the sandal, the post, and quick release fastener;

FIG. 2C is a top view of the post shown in FIG. 2A;

FIG. 2D is a side cross-sectional view showing attachment of the straps of one embodiment of the sandal at a rear portion of the sole of the sandal.

FIG. 2E is perspective view of the sandal, the straps, and the post of the sandal kit of FIG. 2, but shown prior to being customized;

FIG. 2F is a cross-sectional view through the rubber-band covered tube of the strap for the sandal of FIG. 2;

FIG. 2G is a cross-sectional view showing an alternate embodiment for the rubber-band covered tube of the strap for the sandal of FIG. 2, which also includes a cushion member between the rubber band and the tube;

FIG. 2H is a cross-sectional view showing an alternate embodiment for the rubber-band covered tube of the strap for the sandal of FIG. 2, which utilizes an oversized cushion member to provide an air gap between the interior surface of the cushion member and the tube;

FIG. 3 is a perspective view of the custom insert shown in FIG. 2, which may be received into a correspondingly shaped recess in the sole for customization of the sole, along with a key and a folded $20 bill that may be stored in a sealable cavity of the insert;

FIG. 3A is a front view of the custom of FIG. 3;

FIG. 3B is a top view of the custom insert of FIG. 3;

FIG. 3C is a rear view of the custom insert of FIG. 3;

FIG. 4 illustrates an alternate embodiment of the sandal of FIG. 2, which includes provisions for using and retaining a scented element therein;

FIG. 5 illustrates at other alternate embodiment of the sandal of FIG. 2, being shown with an LED strip secured about the periphery of the sole of the sandal, and with an ornament clipped to the thong and straps of the sandal;

FIG. 6A is a front view of the ornament shown in FIG. 5;

FIG. 6B is a side view of the ornament of FIG. 6A;

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this documents are incorporated herein in their entirety by reference.

Furthermore, the described features, advantages, and characteristics of any particular embodiment disclosed in the following specification, may be combined in any suitable manner with any of the other embodiments disclosed herein.

Figure 1:
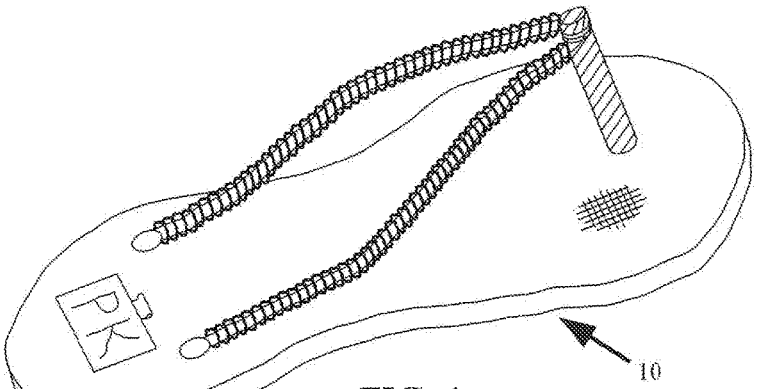
FIG. 1 illustrates a perspective view of a customized sandal that has been assembled in accordance with the teachings of the present invention.
Figure 2:
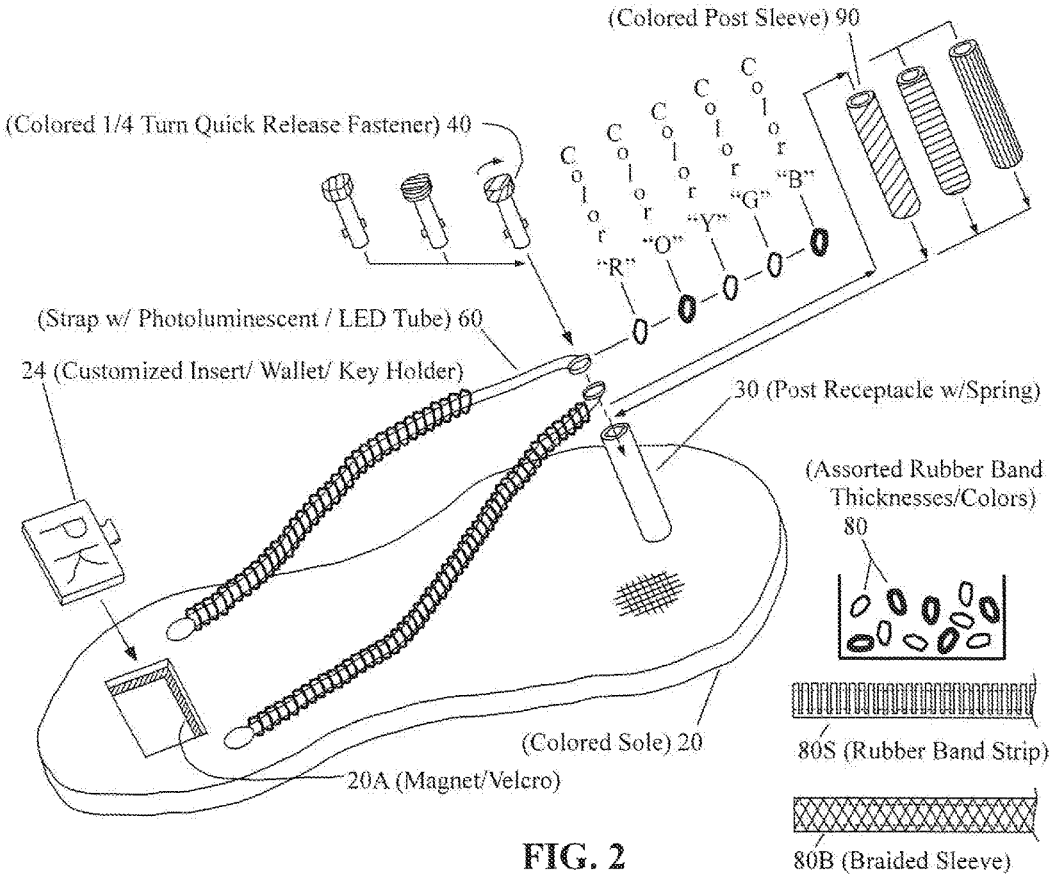
FIG. 2 illustrates an exploded view of a sandal craft kit of the present invention, permitting customization of the straps, customization of the thong using a sleeve and a quick release fastener, and customization of the sole.

FIG. 1 illustrates a perspective view of a customized sandal that has been assembled in accordance with the teachings of the present invention, and which may be assembled using the sandal craft kit shown in FIG. 2.

The sandal craft kit shown in FIG. 2 may include a sole 20, which may be of a particular color, and the kit may furthermore include a plurality of other soles (not shown), each of which may be a different color from the color used for sole 20. Sole 20, as well as any other soles supplied with the kit, may be generally flat, having a bottom surface 21 intended to contact the ground (see FIG. 2A), an upper surface 22 upon which the wearer's foot may rest, and a peripheral surface 23. The size and shape of bottom surface 21, upper surface 22, and peripheral surface 23 may of course be configured in various different sizes to correspond to the size of the feet of various different wearers of the sandal.

Instead of a the typical "thong" at the forward part of the sole 20 to be received between the wearer's big toe and second toe (see e.g., U.S. Pat. No. 2,565,707 to Walsh), a post 30 may be utilized. Post 30, as seen in FIG. 2B, may have a receptacle portion between a first end 31 and a second end 32. Protruding from the second end 32 may be a shaft 33, the distal end of which may have a laterally protruding shoulder 34, and which may be generally flat at 32'. The second end 32, the shaft 33, and the shoulder 34 may be received (e.g., pressed into) the correspondingly shaped opening in the sole 20 that is shown in FIG. 2B, to be secured thereto as seen in FIG. 2A.

The first end 31 of post 30 may have an opening defining a hollow interior. The opening, as seen in FIG. 2C, may be formed to create a substantially cylindrical interior surface 35, which may be interrupted by a first keyway opening 36, and a second keyway opening 37, with the second keyway opening being clocked to be 180 degrees away from the first keyway. (Note that the outer surface of the post 30 may be cylindrical, shown by the circle depicted in FIG. 2C, or it may instead be formed to be oblong, and be made of a soft cushioning material, to provide greater comfort). With the post 30, at some distance between the first end 31 and the second end 32, the cylindrical opening may expand/transition outwardly for form cylindrical surface 38, at which the two keyways 36 and 37 may terminate. However, the transition between the cylindrical surface 35 and cylindrical surface 38 may be generally abrupt (i.e., form a step 39 in the vertical direction), and the transition may also result in a sculpted lateral formation which may include a recess 39R (FIG. 2A) that may be positioned adjacent to a downwardly extending leg 39D. A helical spring 19 may be inserted through the opening, and may have an undeflected length such that its upper end may normally be proximate to the start of the recess 39R.

The post 30 being so formed may thus be configured to releasably receive a fastener 40 in a one-quarter turn, quick release manner. Fastener 40 is shown in FIG. 2B, and may have a first end 41, and a second end 42. The fastener 40 may have a head 43 beginning at the first end 41, and a shaft 44 protruding therefrom and extending to the second end 42. The shaft 44 may have a pair of rectangular protrusions 46 and 47 protruding from opposite sides of the shaft, both of which may extend in the axial direction of the shaft. The shaft 44 of fastener 40 may be sized to be inserted into cylinder 35 of the post 30, with the shaft being clocked so that the rectangular protrusions 46 and 47 of the shaft may enter the corresponding keyways 36 and 37 of the post 30. The second end 42 of the fastener 40 may contact the upper end of the spring 19, which may act to generally oppose such motion.

As the shaft 44 continues to be inserted into cylinder 35 in opposition to the spring biasing, the rectangular protrusions 46 and 47 of the shaft may exit the keyways 36 and 37, and be within the larger cylindrical opening 38 of post 30, at which time the head 40 of the fastener may be rotated. After being rotated approximately 90 degrees, the sides of the rectangular protrusions 46 and 47 may respectively contact the sides of the downwardly extending legs 39D of the transition. Upon releasing of the downward force being applied to the head of the fastener 40, the spring 19 may bias the fastener upwardly, such that the tops of the rectangular protrusions 46 and 47 may each be received within the corresponding recess 39R. (Note, that use of only one rectangular protrusion on the shaft 44 of the fastener 40 may operate substantially the same, and may similarly provide a one quarter turn, quick-release arrangement).

The downward extending legs 39D of the transition on post 30 may be long enough so that the bottom of the head 43B may contact the top 31 of the post 30, to assure that the sides of the rectangular protrusions 46 and 47 would necessarily contact the respective sides of the downward extending legs 39D, and not pass below them. Moreover, the positioning of the rectangular protrusions 46 and 47 with respect to the bottom 43B of the head 43 may permit the head bottom to contact the first end 31 of the post 30, such that the top of the rectangular protrusions 46 and 47 is below the bottom of the step 39, even when a pair of attachment rings (see e.g., FIGS. 2 and 2E) may be positioned on the shaft 44 and may be sandwiched between the bottom of the head and the top of the post. It should also be noted that other quick release fasteners, and corresponding receptacle arrangements within the post (or the sole, as discussed hereinafter), may alternatively be used, such as those shown by: U.S. Pat. No. 3,145,441 to Strandrud; U.S. Pat. No. 3,238,834 to Appleberry; U.S. Pat. No. 3,247,753 to Appleberry; U.S. Pat. No. 3,474,506 to Metz; U.S. Pat. No. 5,368,347 to Holtman; U.S. Pat. No. 5,517,734 to Korpi; U.S. Pat. No. 5,978,233 to Roscoe; U.S. Pat. No. 6,752,562 to Mills; U.S. Pat. No. 6,786;669 to Tsui; and U.S. Pat. No. 7,736,109 to Schmier.

With the post 30 being so constructed and secured to sole 20, as seen in FIG. 2E, a rear end (61/71) of each of a first strap 60 and a second strap 70 may be secured to the sole 20 proximate to the heel region. The rear ends 61/71 of the straps 60/70 may be secured thereto in a conventional fashion, or each strap end may instead be secured thereto as shown in FIG. 2D, being similarly mounted as the post 30 (i.e., a pair of shoulders disposed on opposite ends of a central shaft region, which may be pressed into the corresponding opening in the sole). The strap 70 may be constructed exactly the same as strap 60, particularly with respect to a ring formed on the second end (62/72) of each strap. Alternatively, as seen in FIG. 2, the ring 60R formed at the second end of strap 60 may be disposed inwardly of the center of the end of the strap, with the ring 70R for strap 70 also being inwardly disposed, so that strap 70 may be a mirrored version (i.e., a right-hand version) of strap 60. This offsetting of the rings 60R/70R may serve to provide some separation between the second ends of the straps.

The central portion of the straps 60/70 between the first and second ends may be formed with the same rectangular cross-section as for a conventional sandal. Alternatively, the central portion of the straps 60/70 between the first and second ends may be formed as a flexible cylindrical member, or it may instead be formed as a hollow tube 63/73. (Note—hereinafter the generic use of the word "tube" is for convenience only, and is not intended to limit any particular embodiment to use of only that latter option). The tube may be formed of clear plastic—a thermoplastic elastomer, or any other suitable material known in the art, and may furthermore be hollow. Where a hollow tube is used, the hallow portion may be filled with a liquid and glitter. The tube may also be photo-luminescent, or it may be an LED tube.

The sandal illustrated in FIG. 2E, which therein includes the sole 20, post 30, and straps 60/70 with the rear ends secured to the sole, may then be customized using the sandal craft kit shown in FIG. 2. An assortment of hard plastic loops or elastic rubber bands 80 (hereinafter "loops/bands") of various colors and thicknesses may be supplied in a container of the kit. The person customizing the sandal may selectively choose loops/bands 80 from the container, and may repetitively slide them over the ring of each of straps 60/70, and onto the respective tubes. In one embodiment, the use of rubber bands may be preferable over the use of the hard plastic loops, because the colored elastomeric material, in addition to permitting customization in accordance with one's personal taste, may furthermore serve to increase comfort with respect to contact of the strap with the top of a wearer's foot.

As shown in FIG. 2, a number of loops/bands have already been slid over the ring and onto the center portion of strap 60, while, for example, five additional colored loops/bands are readied to be placed thereon, which are shown to include a red color ("R") band, an orange color ("O") band, a yellow color ("Y") band, a green color ("G") band, and a blue color ("B") loop/band. The loops/bands may be supplied in as many different colors and shades of the visual spectrum as may be desired, and may also include black, white, and shades of gray. The sole may similarly be supplied in any desired color.

Once all of the desired loops/bands have been placed on the straps, which may be more densely packed than is illustrated in FIG. 2, the shaft of the quick release fastener 40 may be inserted through the rings 60R/70R at the ends of each of the straps, and be releasably secured to the receptacle within the post 30, to be as seen in FIG. 1. As shown in FIG. 2, further customization may be provided through the use of a sleeve 90 that may be configured to overlay the post 30, before securing the straps thereto. Various different colored sleeves may be supplied in the kit. In addition, the head of the fastener 40 may similarly the colored, so in addition to choosing the colors for the loops/bands, the wearer may also choose the color/pattern for the sleeve 90 and for the head of the fastener 90, which colors may be selected to match the color of the sole 20, or to contrast with the sole, and/or perhaps contrast each other, or to contrast with the loops/bands on the straps. Alternatively, loops/bands may also be placed on the post instead of the sleeve 90. The wearer may at any time decide to remove the quick release fastener, and change the sleeve for a different color, and/or to change the color of the fastener, and to even exchange a portion or all of the loops/bands on one or both of the straps.

The strap with a rectangular cross-section for a conventional sandal typically has a width ranging between roughly ⅜ of an inch, and ½ of an inch, and is roughly 1/32 of an inch thick, having a cross-sectional perimeter of roughly 0.814 (⅜ plus ⅜ plus 0.032 plus 0.032) or 1.064 (0.5 plus 0.5 plus 0.032 plus 0.0321. Therefore, in one embodiment, the inner diameter of the loops/bands 80 utilized for such a strap may correspond to those dimensions (i.e., the band may have an inner circumference of 0.814 of 1.064), or may instead be slightly larger to introduce some play, and provide a cushion effect. The thickness of the bands may be the same as for a conventional rubber band, which is generally about 1/32 of an inch thick. However, to provide better cushioning, the rubber bands used herein may instead be roughly two to three times thicker than the standard thickness.

Where the cylindrical members or tubes 63/73 are used for straps 60/70, the undeformed inner circumference of the rubber hands utilized may be roughly the same as the outer diameter of the tubes. In one embodiment, the outer diameter of the tubes 63/73 may be ⅜ of an inch, and the thickness of the rubber bands used may be 1/16 of an inch (i.e., two times the standard thickness), which may result in a total outer diameter for the central region of each of the straps of roughly ½ of an inch (i.e., 1/16" plus ⅜" plus 1/16"—see FIG. 2F).

To provide additional cushioning, particularly since the tube of the strap may need to be of sufficient strength and may be made of a stiffer more durable plastic, the tube may be configured to have an outer diameter ¼ of an inch, with a cushioning foam tube 80C having a wall thickness of ⅛ of an inch being received over the tube, and with the rubber bands having a conventional 1/32" thickness next being placed by the wearer over the cushioned tube, as illustrated in FIG. 2G. This may again result in the central region of each of the straps being roughly ½ of an inch in diameter (i.e., 1/32" plus ⅛" plus ¼" plus ⅛" plus 1/32"). In yet another embodiment, the cushioning tube 80C itself may have a custom color scheme/pattern formed thereon, and may obviate the use of multiple colored rubber bands. In addition, the inner diameter of the cushioning tube 80C may slightly larger than the outer diameter of the cylindrical members/tubes 63/73 that are used for each of the straps 60/70, which may result in an air gap therebetween, and may provide some additional cushioning (i.e., requiring some deformation of a portion of the tube prior to compression of the tube locally). Also, instead of a cushioning tube, a rubber band strip 80S may be used, as seen in FIG. 2, which may be a rubber tube with a series of slits oriented normal to its axis, with the slits being provided throughout its length, so that it forms a plurality of rubber bands that are all interconnected along a line at one exterior side of the strip. In addition, rather than using the rubber band strip 80S, a braided sleeve 80B may be used, which may be made of, for example, nylon, and whose ends may be capped or may have flanges to prevent the braiding from unraveling: (see e.g., U.S. Pat. No. 4,983,240). These exemplary embodiments are not intended to be limiting, as other thicknesses and diameters may alternatively be utilized.

As seen in FIG. 2E, the sole 20 of the sandal may optionally have a recess 20R formed therein. When a recess 20R is utilized, a thicker sole 20 may correspondingly be utilized to nonetheless provide adequate structural support. The recess may be formed to any desired shape, including, but not limited to a circular shape, any polygonal shape, an irregular shape, etc. In one embodiment, the recess 20R may be formed to have a rectangular box shape, as shown in FIG. 2E. The recess 20R may receive an insert 24 therein, an example of which is shown in detail within FIGS. 3 to 3C. A first side of the insert 24 may be customized, as desired by the wearer, and may include initials thereon, or a family portrait, a favorite sports car, etc. To add further functionality, the insert 24 may be formed like a wallet to have an opening 25 on one end into a cavity therein, which may be sized to receive a folded $20 bill (or other currency) and/or a key, as seen in FIG. 3. The opening 25 may be sealable using the same structure as may be found on a resealable plastic bag (see e.g., U.S. Pat. No. 4,186,786 to Kirkpatrick), and may be waterproof. The periphery of the bottom surface of the insert 24 may have an attachment means 26 integrated therein (e.g., a magnetized material, a hook material of a hook and loop fastening system such as Velcro™, etc.). The periphery of the bottom surface of the recess 20R in the sole 20 may have a corresponding attachment means 20A secured thereto (e.g., a magnetized material, or a loop material of a hook and loop fastening system), as seen in FIG. 2, which may permit the insert 24 to be releasably secured within the recess 20R of sole 20. The bottom surface of the insert 24 may be made of a stretchable/elastic material, which may allow a key held in the cavity therein to bulge outwardly of the bottom of the insert, and occupy the space in the recess 20R between the sides of the attachment means 20A located at the periphery therein. A tab 27 may extend from one end of the insert 24, which may be grasped by the wearer of the sandal to more easily remove the insert from the recess. When installed therein, as seen in FIG. 1. The rectangular insert 24 may extend from one side of the sandal to the other, as seen in FIG. 1, or it may instead extend from the rear end towards the front end of the sandal, to accommodate a larger key.

Another feature that may be incorporated into the sole of the sandals of the present invention is a scented element. (Note any features disclosed in this specification may be incorporated into any of the alternative embodiments described herein). As shown in FIG. 4, a scented element 150 may have a cylindrical shell, with a "key" protruding from one of its sides, which may extend along at least a portion of its axis. The top of the shell of the element 150 may have a series of holes (e.g., 151A, 151B, etc.) therein. The sole 120 of the sandal may have a corresponding "keyway" opening 120S formed therein which may extend laterally across at least a portion of the sandal, or it may extend in any other desired direction. The top surface of the sole 120 of the sandal 110 may have holes (e.g., 120A, 120B, etc.) that are spaced to correspond to the holes in the scented element. The extent of the opening 120S in the sole 120 may be formed such that when the scented element 150 is fully inserted therein, the spaced holes (151A, 151B, etc.) in the shell of element 150 may be substantially aligned with the spaced holes (120A, 120B, etc.) of the sole 120. The scented element 150 may be held in the opening 120S in the sole 120 using a friction fit.

FIG. 5 illustrates other features that may be incorporated into any of the sandal embodiments described herein. A decorative ornament 155, which is shown in detail in FIG. 6A and FIG. 6B, may have three spring clips (156A, 156B, and 156C) fixedly mounted on its rear surface. The size and shape of the spring clips (156A, 156B, and 156C) may be configured to respectively grasp the thong and straps of the sandal, for mounting of the ornament 155 thereto, as shown in FIG. 5. In addition, the sandal may have a LED strip 157 fixedly attached about the side peripheral surface of the sandal, which may be used to light up the periphery of the sandal.

Figure 7:
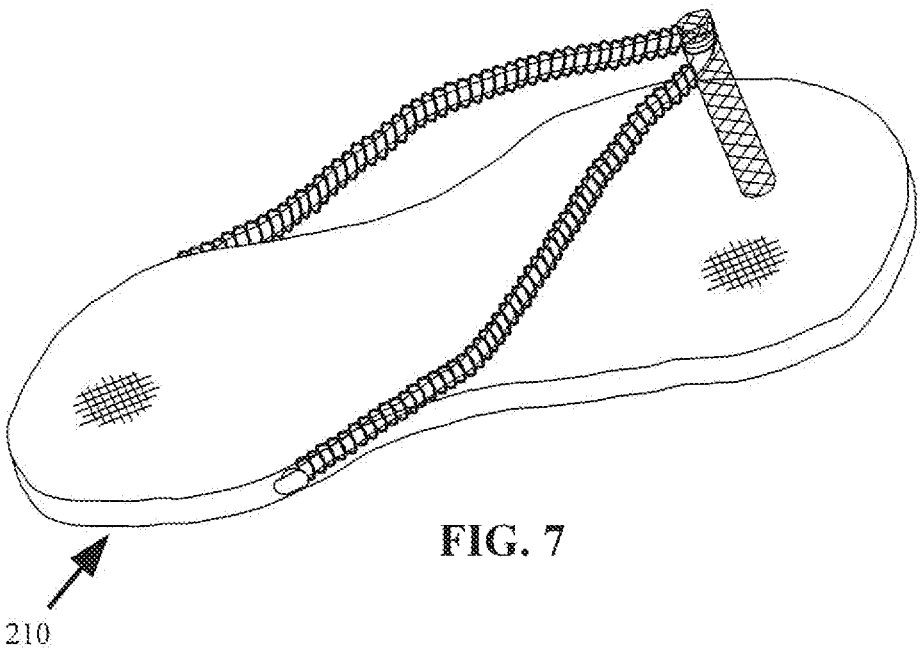
FIG. 7 is a perspective view of another alternate embodiment of the sandal arrangement shown in FIG. 2, being shown with releasable attachment of the rear end of the straps at a side peripheral surface at a rear portion of the sole, using a quick-release fastener.
Figure 8:
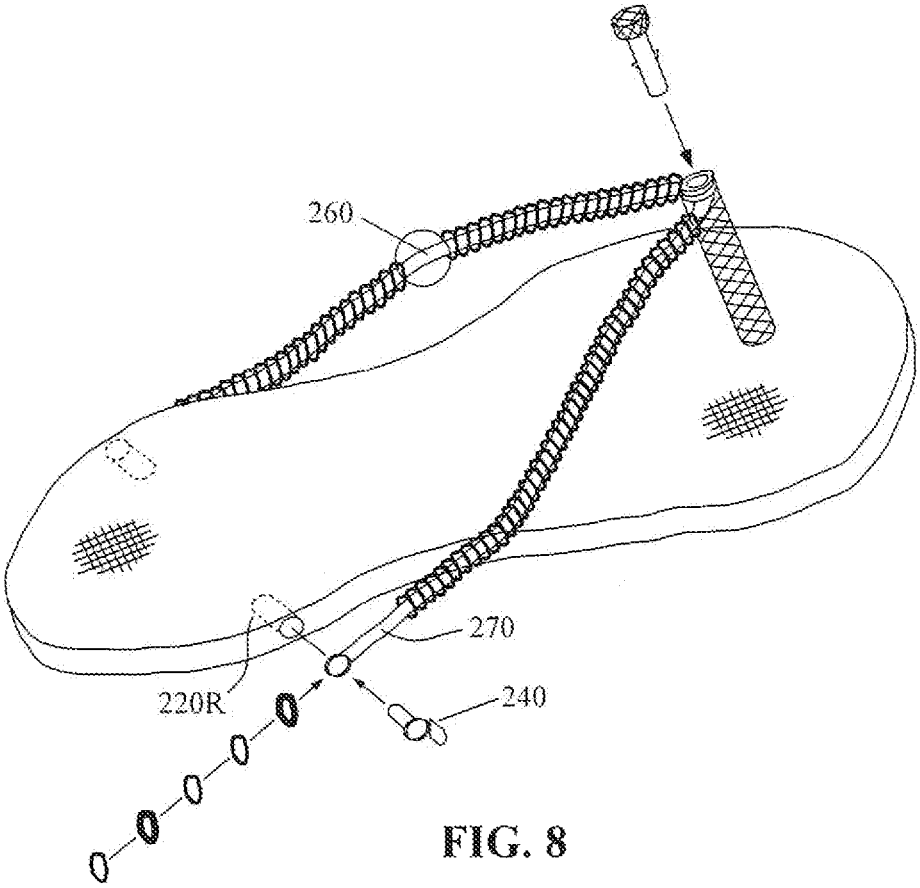
FIG. 8 is the perspective view of FIG. 7, but shown with the quick release fastener having been removed, the end of the strap moved away from the sole, and with several of the bands having been removed from the end of the strap.

FIG. 7 illustrates a sandal embodiment 210, which may be constructed as shown in FIG. 8, being substantially the same as sandal 10, except that the rear ends of the straps 260/270 may similarly be configured with a ring. The ring may be releasably attached to the sole 220 using a quick release fastener that may be secured to a receptacle 220R secured within the sole. (Note that a dwell fastener 240 is shown in FIG. 7 and FIG. 8 for the rear attachment of the strap to the receptacle within the sole, but any other quick release fastener may instead be used, along with the corresponding receptacle). Therefore the rubber bands may be placed unto the strap at either its front end or its rear end. This dual attachment for the straps furthermore permits the wearer to completely interchange any of the sets of straps that may have already been desirably covered with colored rubber bands, with a sole of a different color, removing the quick release fasteners at each end of the strap.

In another embodiment, the straps seen in FIG. 8 may both be fixedly connected to the post, as with the typical connection to the thong of a convention sandal, eliminating the need for the quick release fastener thereat. In this embodiment, rubber bands would need to be added/removed at the rear of the straps, once the dwell fastener was removed.

Figure 9:
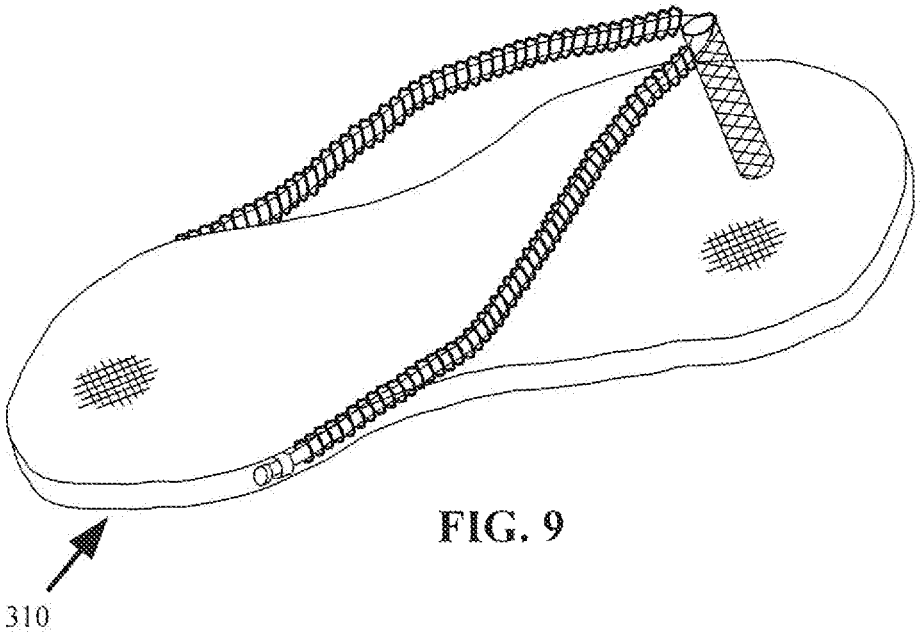
FIG. 9 is a perspective view of another alternate embodiment of the sandal arrangement shown in FIG. 2, being shown with a cylindrically-shaped rear end of the strap passing through a loop protruding from the sole, and being releasably secured thereat using a threaded cap.
Figure 10:
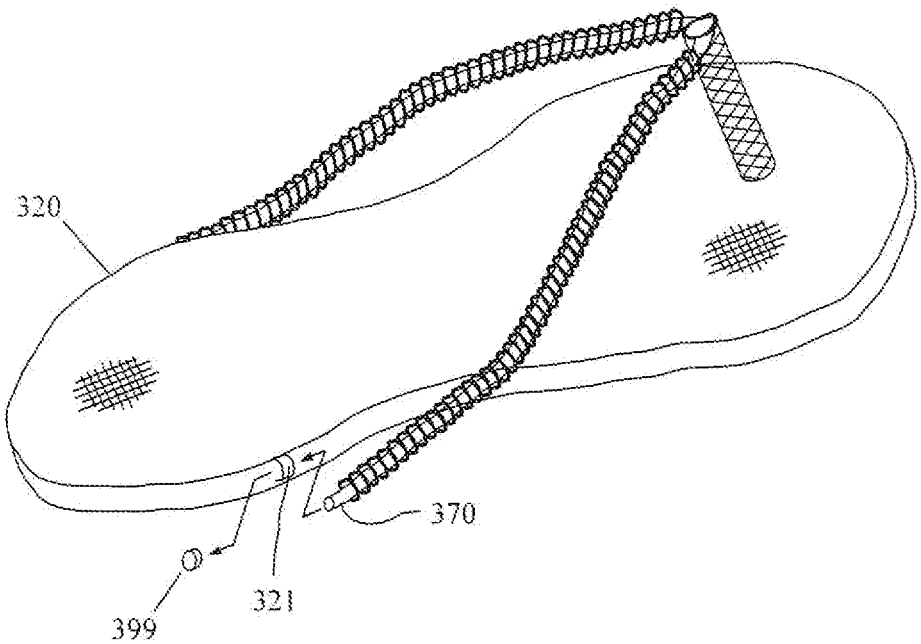
FIG. 10 is the perspective view of FIG. 9, but shown prior to the threaded cap having been attached to the strap, and prior to the end of the strap having been passed through the loop in the sole.

In yet another sandal embodiment 310, shown completed in FIG. 9, each of the rear ends of the straps may terminate, as seen for strap 370 in FIG. 10, without a ring, being only cylindrical thereat. A loop 321 may be secured to each side of the sole 320. The cylindrical end of the straps may be passed through the corresponding loop 321, after which a cap 399 may be secured thereto. The cap may be releasably secured thereto using internal and external threading on the cap and the strap, respectively. Alternatively, the cap may be fixedly secured thereto, using any suitable means, including an adhesive.

Figure 11:
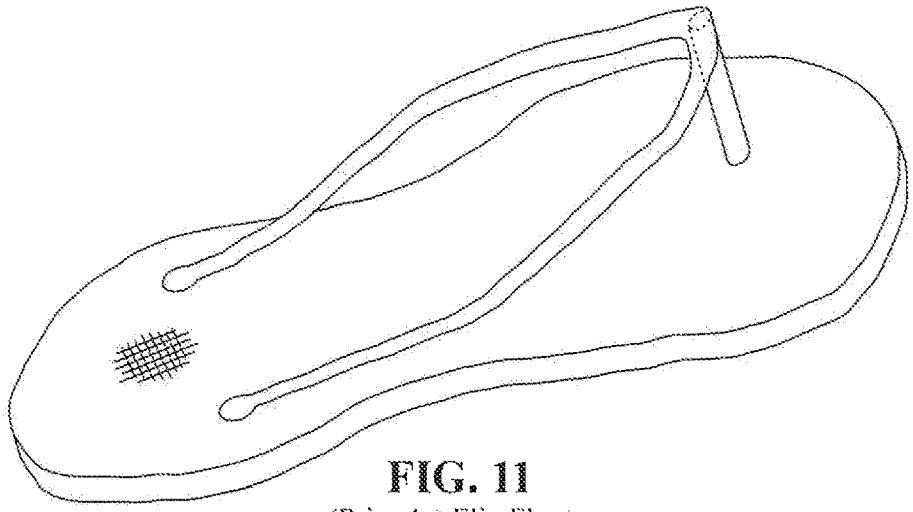
FIG. 11 is a perspective view of a prior art flip flop.
Figure 12:
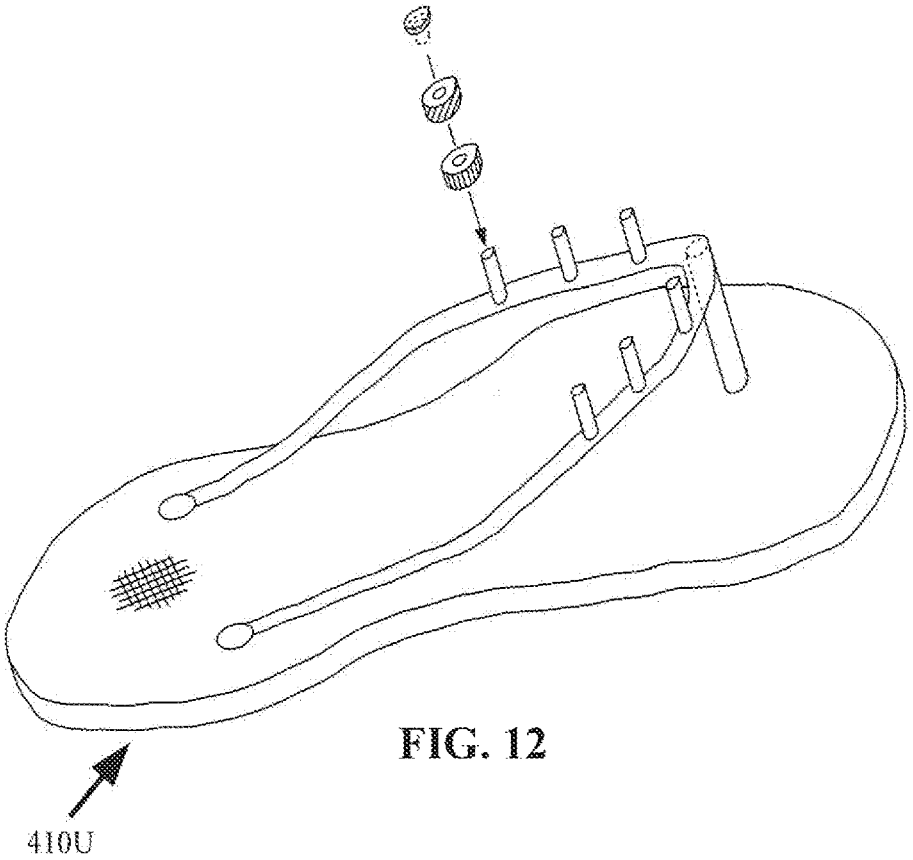
FIG. 12 is a perspective view of another embodiment of the present invention, wherein a series of pegs may protrude upwardly from the top of the strap of the flip flop, where the pegs may receive various colored rings and/or shaped figures thereon.
Figure 13:
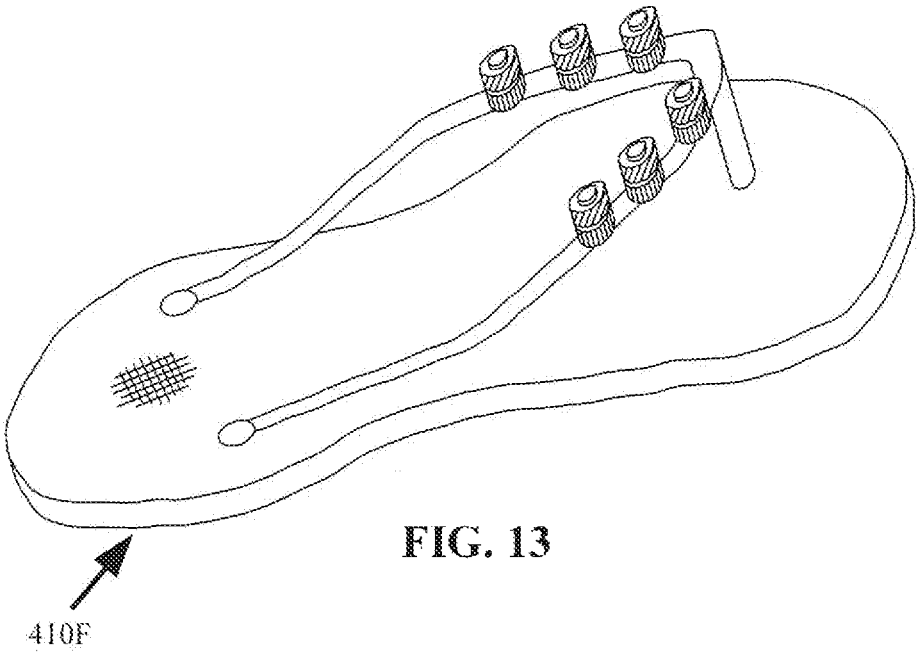
FIG. 13 is the flip flop of FIG. 12, but is shown with a plurality of colored rings secured to each of the pegs using a clip at the top of each of the pegs.

In yet another flip flop embodiment 410F, shown completed in FIG. 13, the strap of a conventional flip flop (FIG. 11) may be formed with a series of pegs/cylinders that may protrude upwardly from the top of the strap of the flip flop, as seen in FIG. 12 for flip flop 410U. The pegs may receive various colored rings and/or shaped figures thereon, which may be secured to each of the pegs using a clip at the top of each of the pegs. The clip may be threaded onto the pegs, or may be bonded thereto, or may be attached using any other means of mechanical attachment known in the art.

Figure 14:
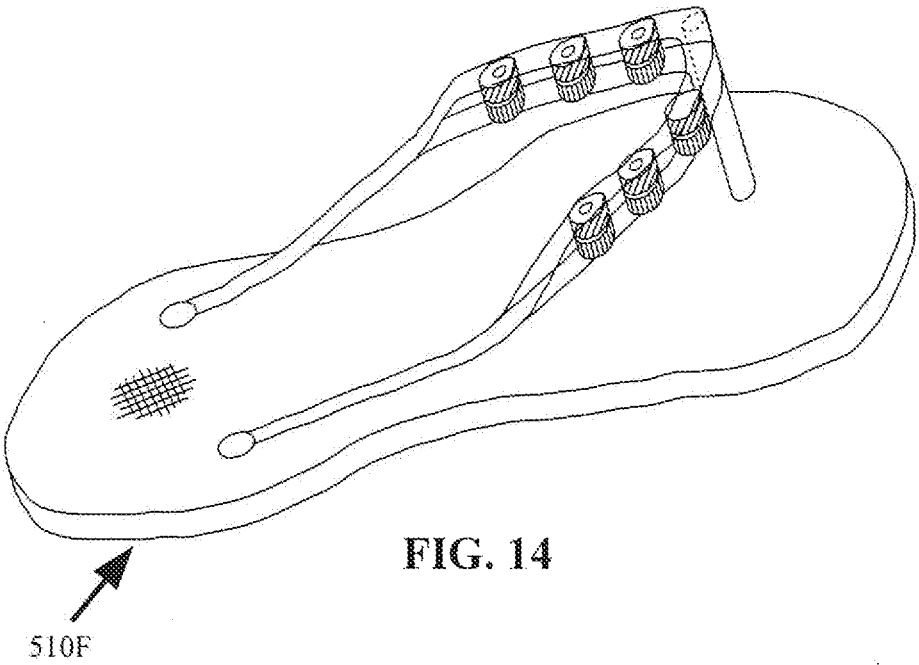
FIG. 14 is the flip flop of FIG. 13, but is shown with the colored rings secured to the pegs using a secondary upper strap member, instead of the clips.

Another flip flop embodiment 510F, shown in FIG. 14, may be made the same as the flip flop 410F of FIG. 13, but the colored rings may instead be secured to the pegs using a secondary upper strap member, instead of the clips.

Figure 15:
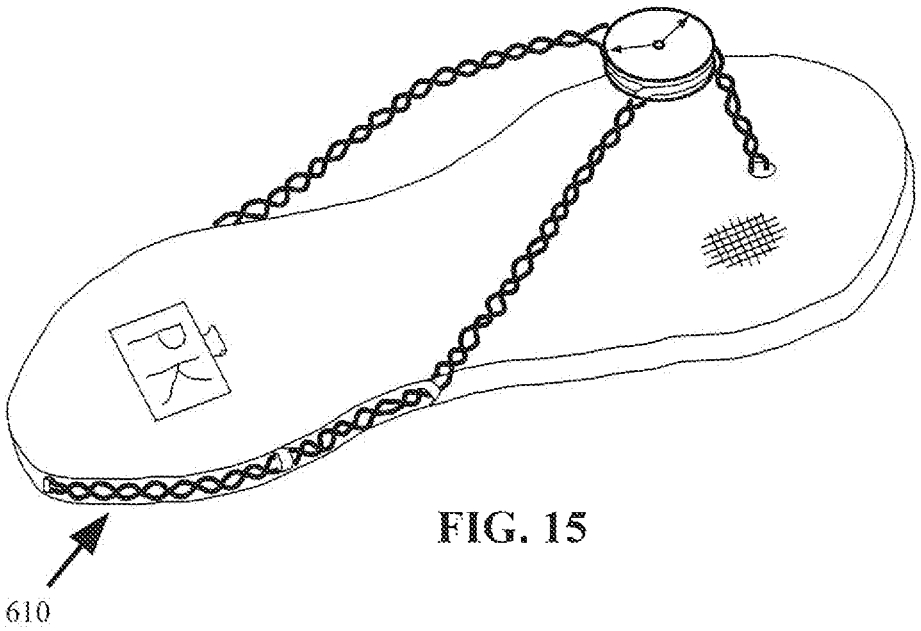
FIG. 15 is a perspective of another embodiment of the present invention, which includes a braided thong and braided straps, which may be used to secure an ornament thereto, where the ornament may be functional and may be in the form of a watch.

FIG. 15 shows a perspective view of a flip flop embodiment 610, which may include a braided thong and braided straps, which may be used to secure an ornament thereto, where the ornament may be functional and may be in the form of a watch.

Figure 16:
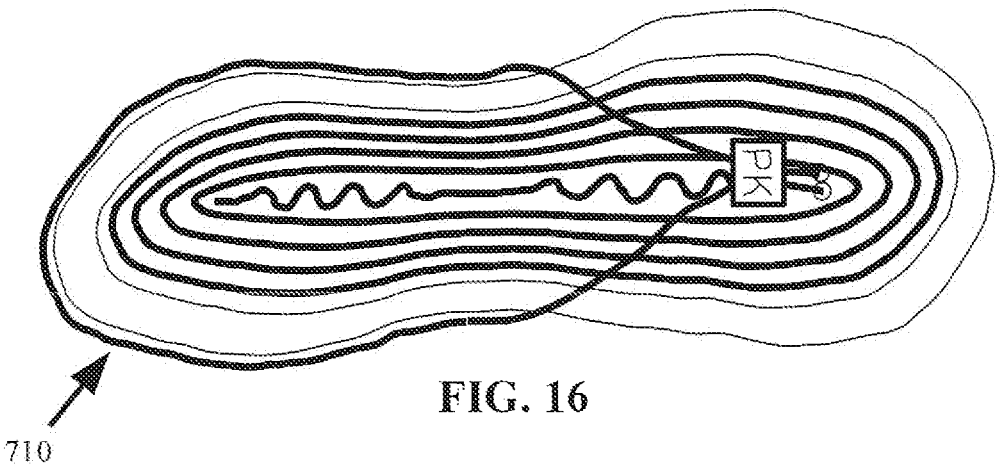
FIG. 16 is a top view of another embodiment of the present invention, which includes a flexible rubber or plastic cylindrical member that is secured to the top of the base of the flip flop in a circuitous manner, to provide comfort to the bottom of the wearer's foot, and with other cylindrical members being used for the straps.
Figure 17:
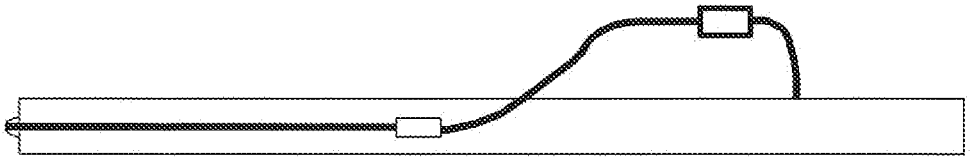
FIG. 17 is a side view of the flip flop of FIG. 16.

FIGS. 16 and 17 show top and side views of another embodiment 710 of the present invention, which may include a flexible rubber or plastic cylindrical member that may be secured to the top of the base of the flip flop in a circuitous manner, which may provide comfort to the bottom of the wearer's foot, and with other cylindrical members being used for the straps. A tchotchke may be secured to the straps near the thong.

Figure 18:
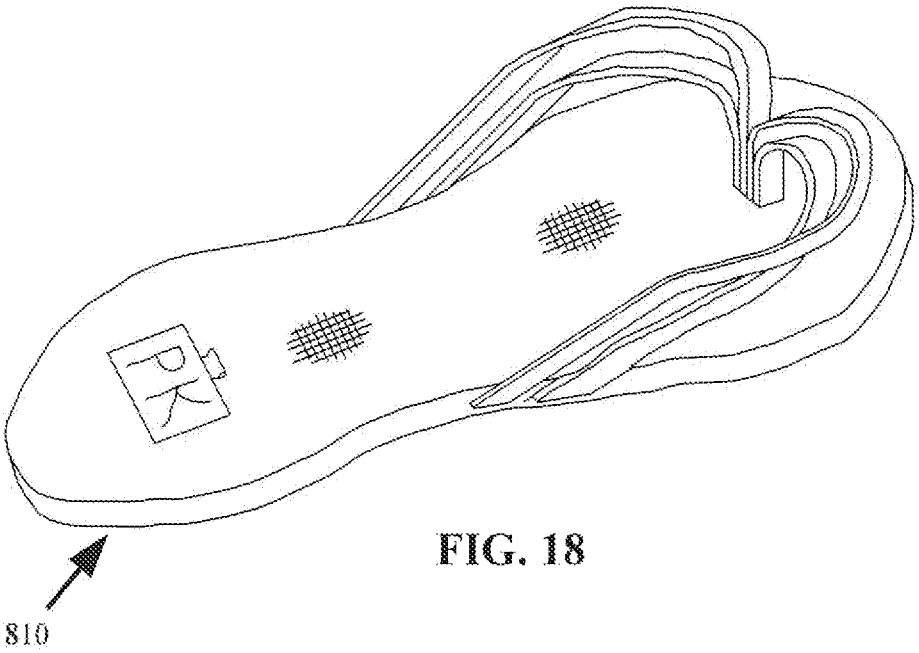
FIG. 18 is a perspective view of another embodiment of the present invention, which has its upper formed of a slit rectangular member that is folded in a particular manner to be shaped as shown, and which is secured to the base of the flip flop to form a pair of cascading straps an each side.

FIG. 18 is a perspective view of another embodiment 810 of the present invention, which may have a sole, and its straps and thong integrally formed from a slit rectangular member that is folded in a particular manner to be shaped as shown. A distal end of each of the first pair of straps may be fixedly secured to a first peripheral side of the sole, and a distal end of each of the second pair of straps may be fixedly secured to a second peripheral side of the sole.

Figure 19:
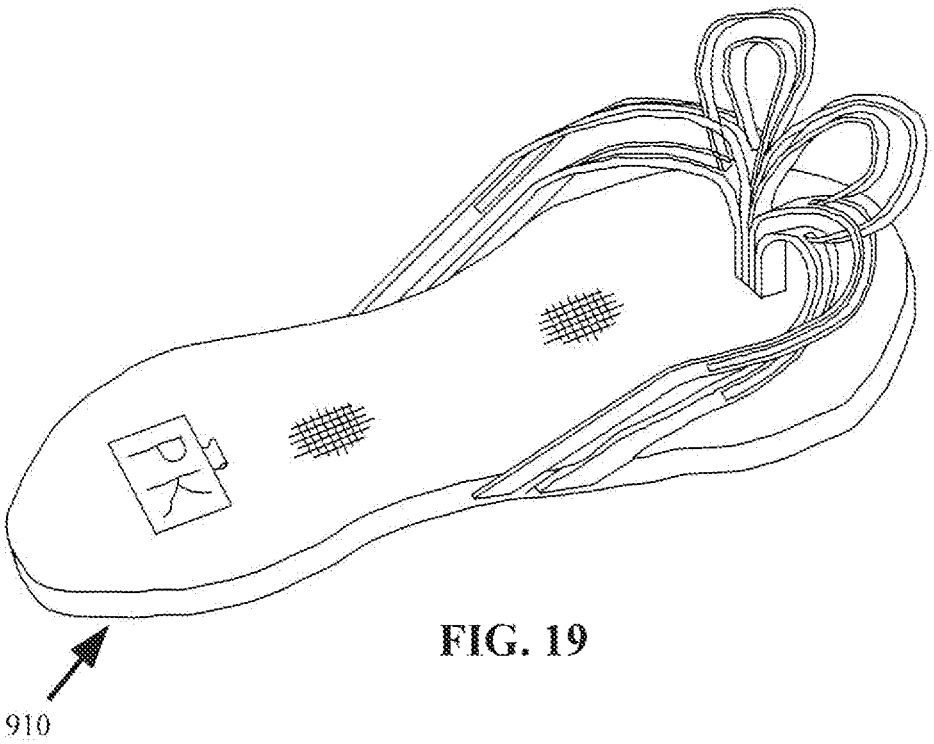
FIG. 19 is the flip flop of FIG. 18, but where additional slits are used to form additional flanged members that may be folded in a reverse direction to create an additional ornamental shape.

FIG. 19 is a flip flop embodiment 910, which may be made the same as the flip flop 810 of FIG. 18, but where additional slits may be used to form additional flanged members that may be folded in a reverse direction to create an additional ornamental shape proximate to the thong.

Figure 20:
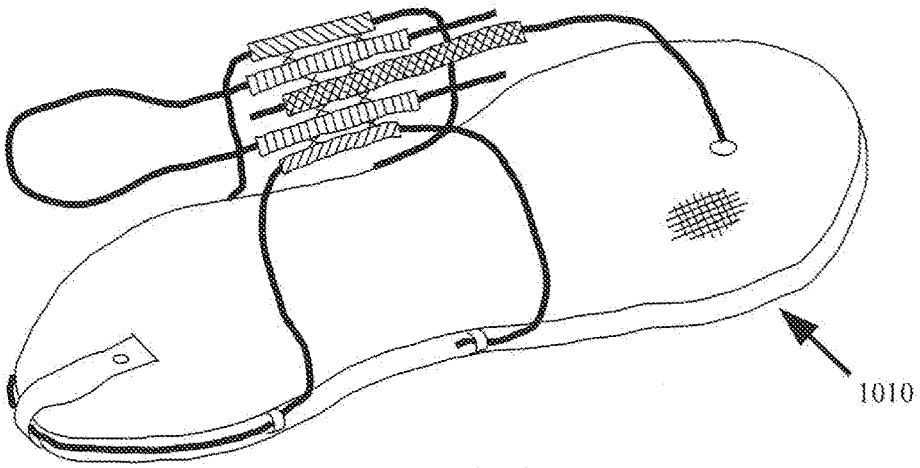
FIG. 20 is a perspective view of another embodiment of the present invention, which has the straps formed of a flexible plastic or rubber cylindrical member, and which may be overlaid by colored tube members that are interchangeable.

FIG. 20 is a perspective view of another embodiment 1010 of the present invention, which may have the straps formed of a flexible plastic or rubber cylindrical member, and which may be overlaid by colored tube members that are interchangeable. The ends of the straps may be secured to the side peripheral surface of the sole using loops formed thereat. Where one of the straps may be continuous around the rear of the sole, a flap may be used thereat to secure the strap to the sole.

Figure 21:
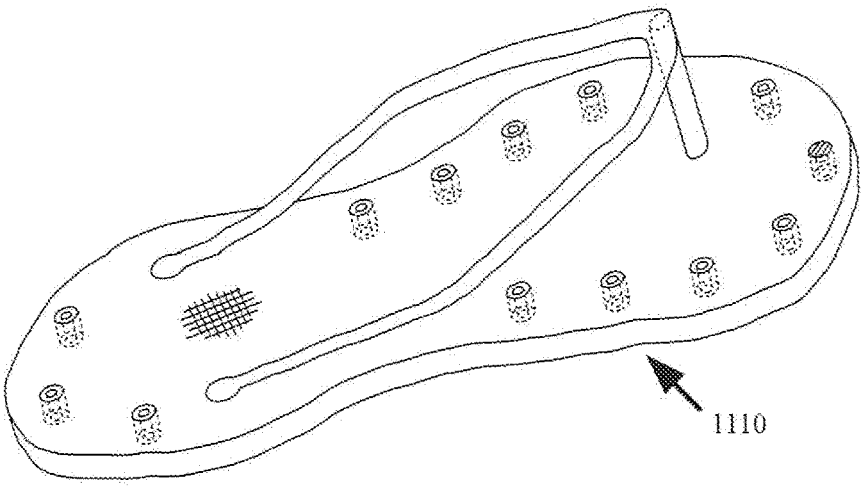
FIG. 21 is a perspective view of another embodiment of the present invention, in which the base of the flip flop includes a series of transverse holes formed proximate to its periphery, which holes may each include a tube therein to provide ventilation.

FIG. 21 is a perspective view of another embodiment 1110 of the present invention, in which the base of the flip flop may include a series of transverse holes formed proximate to its periphery, which holes may each include a tube therein to provide ventilation to the bottom of the wearer's foot.

Figure 22:
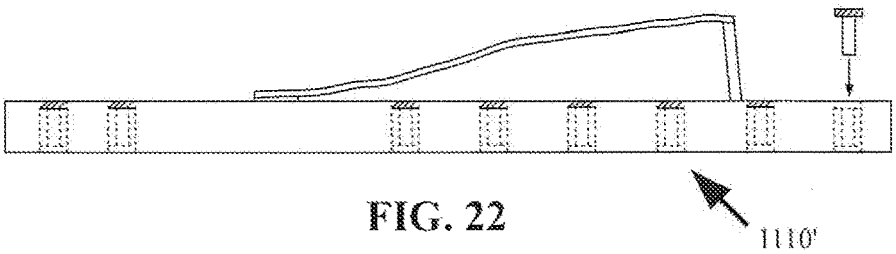
FIG. 22 is the embodiment of FIG. 21, but shown with the tubes foreshortened and secured within the hole, and being configured to receive and releasably support a colored/decorative insert therein, each of which may be easily interchanged.

FIG. 22 is an embodiment 1110' that may be formed the same as the embodiment in FIG. 21, but where the tubes may be foreshortened and secured within the hole (or may even be eliminated), and a colored/decorative insert member, which may resemble a bolt with or without the threads, may be inserted therein, each of which may be easily interchanged. The threaded decorative insert members may be formed of a plastic, or a rubber material, and the rubber may be formed to have the same elasticity as the material of the sole. However, to reduce the tendency of the insert to pop out of the opening as the user walks and the sole experience flexure (e.g., compressive forces), the insert may be made of a material having a greater elasticity that that of the sole. The tops of the inserts, along with portions of the sole, may also be formed of a rough abrasive surface like fine sandpaper, to aid in callous removal.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the attached claims and their equivalents.

What is claimed is:

1. A customizable flip flop comprising:

a sole;

a first strap having a cross-sectional perimeter size, a first end of said first strap secured to a first side of a rear portion of said sole; a second end of said first strap comprising a ring;

a second strap having a cross sectional perimeter size, a first end of said second strap secured to a second side of said rear portion of said sole; a second end of said second strap comprising a ring;

a plurality of rubber bands having an inner diameter substantially corresponding to said cross-section perimeter size of said first strap to facilitate placing the rubber bands at desired locations along said first strap;

a plurality of rubber bands having an inner diameter substantially corresponding to said cross-section perimeter size of said second strap to facilitate placing the rubber bands at desired locations along said second strap;

a quick release fastener comprising a head and a shaft; said ring of said first strap and said ring of said second strap slidably received upon said shaft; and a post, a bottom portion of said post secured to said sole at a position adapted for said post to be received between a big toe and a second toe of a wearer of said customizable flip flop; an upper portion of said post comprising a receptacle adapted for said quick release fastener to be releasably secured thereto.

2. The customizable flip flop according to claim 1 wherein said quick release fastener is releasably secured to said receptacle through one-quarter of a rotation.

3. The customizable flip flop according to claim 1 wherein said plurality of rubber bands received on said first strap comprise a first sequence of rubber bands of various different colors; and wherein said plurality of rubber bands received on said second strap comprise a second sequence of rubber bands of various different colors.

4. The customizable flip flop according to claim 1 wherein said plurality of rubber bands received on said first strap and said plurality of rubber bands received on said second strap each respectively comprise rubber bands of various different colors and thicknesses.

5. The customizable flip flop according to claim 1 wherein said plurality of rubber bands received on said first strap and said plurality of rubber bands received on said second strap each respectively comprise a plurality of rubber bands of various different colors, thicknesses, and outer diameters.

6. The customizable flip flop according to claim 1 wherein said first end of each of said first and second straps is secured through a top surface of said rear portion of said sole.

7. The customizable flip flop according to claim 1 wherein said first end of each of said first and second straps is secured to a peripheral surface of said rear portion of said sole.

8. A customizable flip flop comprising:

a sole;

a post, a bottom portion of said post secured to said sole at a position adapted for said post to be received between a big toe and a second toe of a wearer of said customizable flip flop; said post comprising a receptacle;

a quick release fastener;

a first strap having a cross-sectional perimeter size, a first end of said first strap secured to a first side of a rear portion of said, sole; a second end of said first strap comprising means for releasable attaching said second end to said quick release fastener;

a second strap having a cross-sectional perimeter size, a first end of said second strap secured to a second side of said rear portion of said sole; a second end of said second strap comprising means for releasable attaching said second end to said quick release fastener;

a plurality of rubber bands having an inner diameter substantially corresponding to said cross-section perimeter size of said first strap to facilitate placing the rubber bands at desired locations along said first strap;

a plurality of rubber bands having an inner diameter substantially corresponding to said cross-section perimeter size of said second strap to facilitate placing the rubber bands at desired locations along said second strap; and wherein said receptacle is adapted for said quick release fastener to be releasably secured thereto.

9. The customizable flip flop according to claim 8 wherein said quick release fastener is releasably secured to said receptacle through one-quarter of a rotation.

10. The customizable flip flop according to claim 8 wherein said plurality of rubber bands received onto said first strap comprise a first sequence of rubber bands of various different colors; and wherein said plurality of rubber bands received on said second strap comprise a second sequence of rubber bands of various different colors.

11. The customizable flip flop according to claim 8 wherein said plurality of rubber bands received on said first strap and said plurality of rubber bands received on said second strap each respectively comprise a plurality of rubber bands of various different colors and thicknesses.

12. The customizable flip flop according to claim 8 wherein said plurality of rubber bands received on said first strap and said plurality of rubber bands received on said second strap each respectively comprise a plurality of rubber hands of various different colors, thicknesses, and outer diameters.

* * * * *